US010036196B2

(12) United States Patent
Chen et al.

(10) Patent No.: US 10,036,196 B2
(45) Date of Patent: Jul. 31, 2018

(54) AUTOMATIC CLOSING STRUCTURE FOR SLATS OF SASH

(71) Applicant: NIEN MADE ENTERPRISE CO., LTD., Taichung (TW)

(72) Inventors: Lin Chen, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 370 days.

(21) Appl. No.: 14/963,006

(22) Filed: Dec. 8, 2015

(65) Prior Publication Data

US 2017/0081907 A1 Mar. 23, 2017

(30) Foreign Application Priority Data

Sep. 17, 2015 (CN) ..... 2015 2 0721707 U

(51) Int. Cl.
*E06B 7/096* (2006.01)
*E05F 11/04* (2006.01)
*E06B 3/48* (2006.01)

(52) U.S. Cl.
CPC ..... *E06B 7/096* (2013.01); *E05F 11/04* (2013.01); *E06B 3/481* (2013.01)

(58) Field of Classification Search
CPC ..... E06B 7/096; E06B 3/481; E06B 7/084; E06B 7/086; E06B 9/386; E06B 3/48; E06B 3/9647; E06B 9/266; E06B 9/388; E06B 2009/322; E06B 2009/3225; E06B 9/68; E06B 7/09; E05F 11/04; Y10S 160/902
USPC .... 49/82.1, 183, 73.1, 506, 81.1, 80.1, 74.1, 49/386, 379, 381, 86.1, 89.1, 163, 161; 52/473
See application file for complete search history.

(56) References Cited

U.S. PATENT DOCUMENTS 6,701,669 B1 * 3/2004 Yorgason ..... E06B 7/096 49/82.1
7,434,353 B2 * 10/2008 Nien ..... E06B 7/086 49/403
9,038,314 B2 * 5/2015 Chen ..... E06B 7/096 49/82.1
2005/0252086 A1 * 11/2005 Yorgason ..... E06B 7/096 49/82.1
2005/0257429 A1 * 11/2005 Yorgason ..... E06B 7/096 49/82.1
2008/0178526 A1 * 7/2008 Browne ..... F24F 13/1426 49/82.1
2008/0250717 A1 * 10/2008 Vasquez ..... E06B 7/096 49/74.1
2009/0149123 A1 * 6/2009 Blagg ..... F24F 13/1426 454/258
2013/0118082 A1 * 5/2013 Colson ..... E06B 7/096 49/82.1

(Continued)

*Primary Examiner* — Chi Q Nguyen
(74) *Attorney, Agent, or Firm* — Tracy Heims; Apex Juris, pllc.

(57) ABSTRACT

An automatic closing structure is disclosed, which is installed between a sash and a corresponding object, wherein the sash is pivotable relative to the corresponding object; the sash includes a frame and a plurality of turnable slats which are arranged in parallel in the frame; the automatic closing structure has a cord which is adapted to automatically close the slats, wherein the cord can be easily assembled into the automatic closing structure, and a tightness thereof can be adjusted.

28 Claims, 14 Drawing Sheets

(56) References Cited

U.S. PATENT DOCUMENTS

| | | | | |
|---|---|---|---|---|
| 2014/0033610 | A1* | 2/2014 | Watkins | E06B 7/086 49/82.1 |
| 2014/0166219 | A1* | 6/2014 | Chen | E06B 9/266 160/368.1 |

* cited by examiner

AUTOMATIC CLOSING STRUCTURE FOR SLATS OF SASH

The current application claims a foreign priority to application number 201520721707.1 filed on Sep. 17, 2015 in China.

BACKGROUND OF THE INVENTION

1. Technical Field

The present invention relates generally to a sash, and more particularly to an automatic closing structure for slats of the sash.

2. Description of Related Art

Typically, a sash is composed of a frame and a plurality of slats, which are horizontally arranged in the space surrounded by the frame, wherein the slats are pivotally connected to the frame, and are therefore turnable. By adjusting the angle of the slats between a horizontal direction and a vertical direction, the amount of light from outside and the degree of ventilation can be appropriately regulated.

In other to increase the amount of light from outside and the degree of ventilation, some sashes are designed to have the frame pivotally connected to a window frame of a building. In this way, the opening of the building where such a movable sash is installed can be fully opened by opening the sash completely, which facilitates light and air to enter the room. However, the edges of slats of this kind of movable sash tend to be damaged if the slats are adjusted to the horizontal direction while the sash is being opened toward a wall of the building, or while two sashes are being moved toward each other. Therefore, the conventional movable sashes still have room for improvement.

BRIEF SUMMARY OF THE INVENTION

In view of the above, the primary objective of the present invention is to provide an automatic closing structure, which is able to automatically close slats of a sash. Moreover, the cord included in the structure is easy to be installed, and the tightness of the cord is adjustable.

The present invention provides an automatic closing structure, which is installed between a sash and a corresponding object, wherein the sash is pivotable relative to the corresponding object, and the sash comprises a frame and a plurality of turnable slats which are arranged in parallel in the frame. The automatic closing structure includes a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member. The follower assembly comprises a second linkage member, which is controllable to move the first linkage member in a linear direction. The linkage device comprises a cord, which has a first stop portion, a second stop portion, and a cord portion located between the first stop portion and the second stop portion, wherein the first stop portion is connected to the second linkage member, and the second stop portion is connected to the corresponding object.

The present invention further provides an automatic closing structure, which is installed between a sash and a corresponding object, wherein the sash is pivotable relative to the corresponding object, and the sash comprises a frame and a plurality of turnable slats which are arranged in parallel in the frame. The automatic closing structure includes a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member. The automatic closing structure comprises a rack fixedly provided in the frame. The follower assembly comprises a gear, a movable block, and a second linkage member, wherein the gear is rotatably provided in the movable block, and meshes with the rack; the second linkage member has a flat teeth meshing with the gear at a side opposite to the rack; the second linkage member is controllable to move the movable block, and to consequently move the first linkage member in a linear direction.

The present invention further provides an automatic closing structure, which is installed between a sash and a corresponding object, wherein the sash is pivotable relative to the corresponding object, and the sash comprises a frame and a plurality of turnable slats which are arranged in parallel in the frame. The automatic closing structure includes a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member. The automatic closing structure comprises a locating seat and an adjusting member, wherein the locating seat is fixed on the corresponding object, and has a bore; the adjusting member has a mobile block movably provided on the locating seat. The linkage device comprises a cord passing through the bore of the locating seat; the cord has a first stop portion, a second stop portion, and a cord portion located between the first stop portion and the second stop portion, wherein the first stop portion is connected to the follower assembly, and the second stop portion is connected to the mobile block.

Whereby, the cord can be easily and conveniently installed or even replaced, and the movable block which is connected to the gear is moved over a shorter distance than the second linkage member being moved upward by the cord, which prevents the slats from being excessively closed, and makes the tightness of the cord adjustable.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
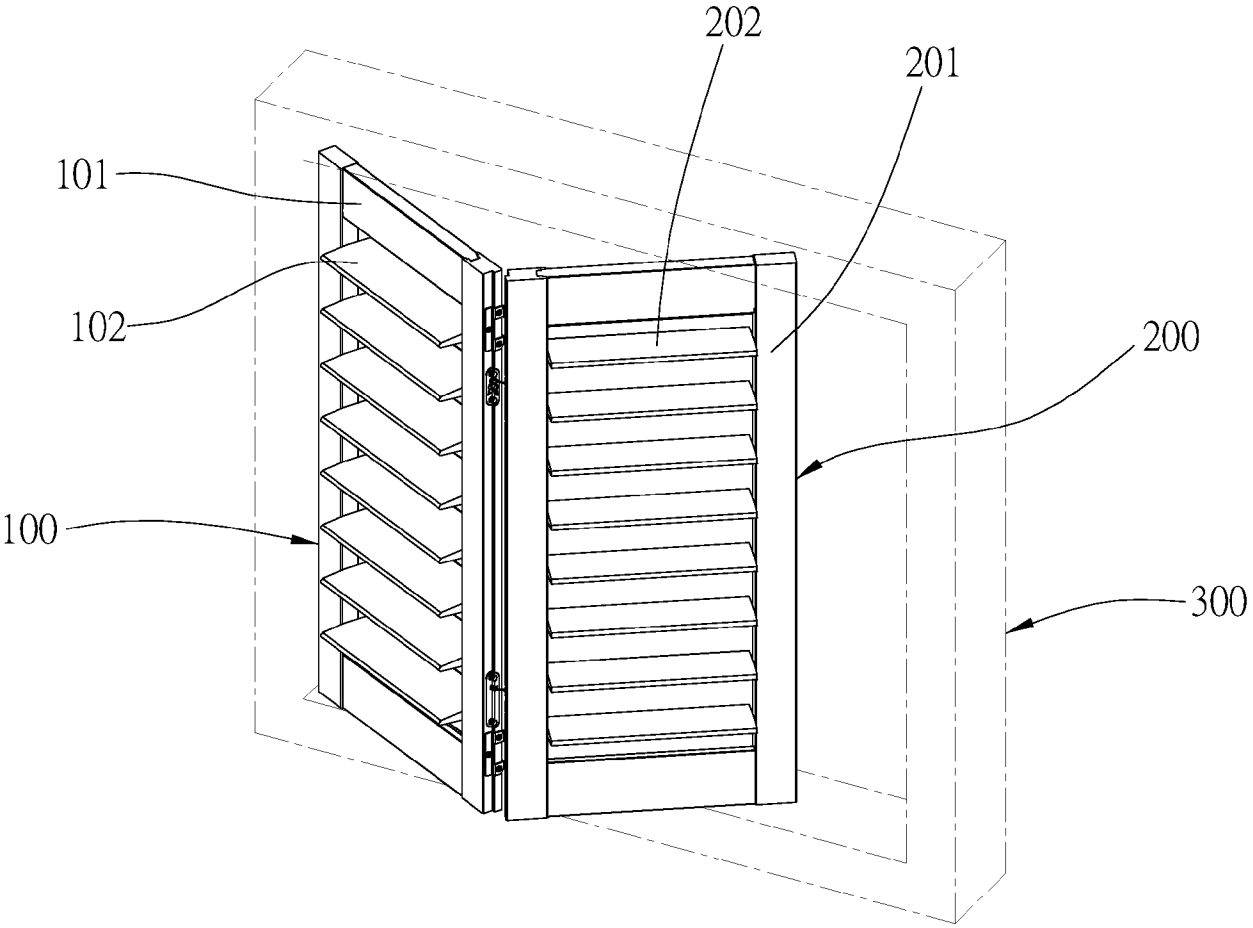
FIG. 1 is a perspective view, showing a building opening covering structure includes two sashes.
Figure 2:
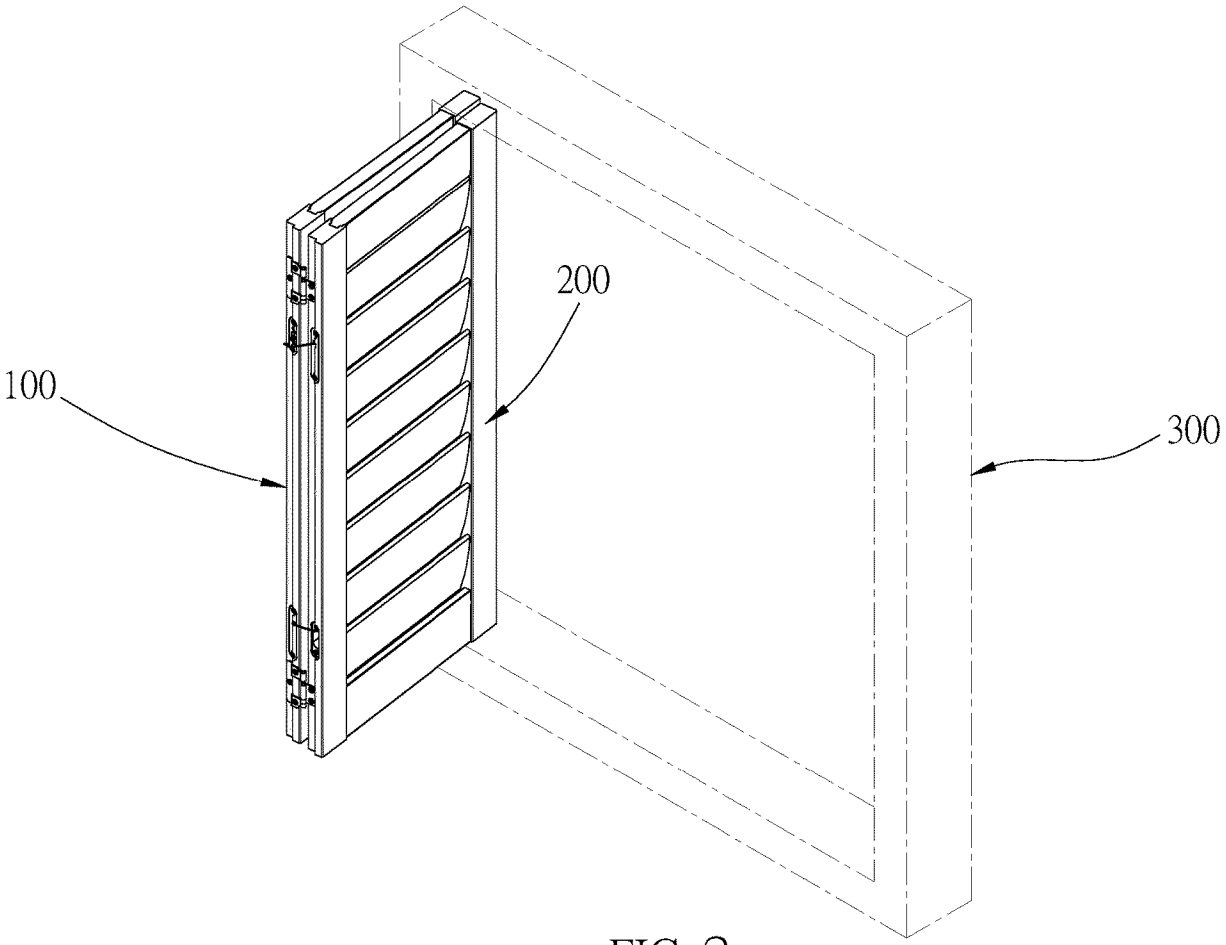
FIG. 2 is a perspective view, showing the sashes of the building opening covering structure are moved to be arranged in parallel with each other.

As shown in FIG. 1 and FIG. 2, a building opening covering structure includes a first sash 100 and a second sash 200 installed in a window frame 300, wherein the first sash 100 is pivotally connected to the window frame 300 with a side thereof, and another side of the first sash 100 is pivotally connected to the second sash 200, whereby the first sash 100 and the second sash 200 can block the opening of the building when expanded, and open the opening of the building when folded together (i.e., arranged in parallel with each other). The aforementioned first sash 100 and second sash 200 have the same structure, each of which includes a frame 101 (201) and a plurality of slats 102 (202), wherein the slats 102 (202) are horizontally arranged in the frame 101 (201), and are turnable to change the degree of coverage.

In a preferred embodiment, the present invention includes two automatic closing structures, which are installed between the aforementioned first sash 100 and second sash 200, wherein one of the two automatic closing structures is used to automatically close the slats 102 of the first sash 100, while the other automatic closing structure is used to automatically close the slats 202 of the second sash 200. For purpose of illustration, herein we take the automatic closing structure applied for the first sash 100 as an example. In this case, the second sash 200 is deemed to be a corresponding object of the first sash 100.

As shown in FIG. 3 to FIG. 8, the automatic closing structure of the preferred embodiment includes a base 10, a lateral lid 12, a locating seat 14, an adjusting member, a plurality of rotary members 22, a follower assembly, and a linkage device.

The base 10 is embedded and fixed into the frame 101 of the first sash 100 through a lateral surface thereof. A side of the base 10 has a longitudinal guide rail 10*a*, and another side thereof has a trough 10*b* recessed from a side surface thereof. The guide rail 10*a* communicates with the trough 10*b*, wherein a bottom of the trough 10*b* is provided with a longitudinal rack 10*c*, which is fixed and unmovable, and each of two lateral walls of the trough 10*b* respectively has a longitudinal and recessed guideway 10*d*. The lateral lid 12 is fixedly connected to the base 10 to enclose the trough 10*b*, wherein the lateral lid 12 has a bore 12*a*; a direction changing wheel 12*b* and a direction changing block 13 are provided inside the lateral lid 12; a direction changing wheel 13*a* is further provided inside the direction changing block 13.

The locating seat 14 is embedded and fixed into the frame 201 of the second sash 200 through a lateral surface thereof. The locating seat 14 has a perforation (not shown) and a bore 14*a*, and further has a lead rail 14*b* on a rear surface thereof extending outwardly. The adjusting member includes a mobile block 16, a screw rod 18, and a C-shaped buckle 20, wherein the mobile block 16 is movably disposed in the lead rail 14*b* of the locating seat 14. The mobile block 16 has a threaded hole 16*a* and a positioning aperture 16*b*. The screw rod 18 is screwed into the threaded hole 16*a* of the mobile block 16 after passing through the perforation of the locating seat 14. The screw rod 18 has an annular limiting groove 18*a* on a body portion thereof, wherein the limiting groove 18*a* is buckled by the C-shaped buckle 20 so that the screw rod 18 can only rotate in situ. In other words, by using a tool (e.g., a screw driver) to rotate the screw rod 18 clockwise or counterclockwise, the mobile block 16 can be moved forwardly or backwardly in the lead rail 14*b* of the locating seat 14 along the screw rod 18.

The rotary members 22 are gears which are respectively provided at a side corresponding to the slats 102. The follower assembly is movably disposed in the frame 101, and includes a first linkage member 24, a follower block 26, a gear 28, a movable block 30, a second linkage member 32, and a biasing member 34. Except for the first linkage member 24, which is disposed outside of the base 10, and the follower block 26, which is movably engaged within the guide rail 10*a* of the base 10, the other components, i.e., the gear 28, the movable block 30, the second linkage member 32, and the biasing member 34 are all received in the trough 10*b* of the base 10.

Figure 3:
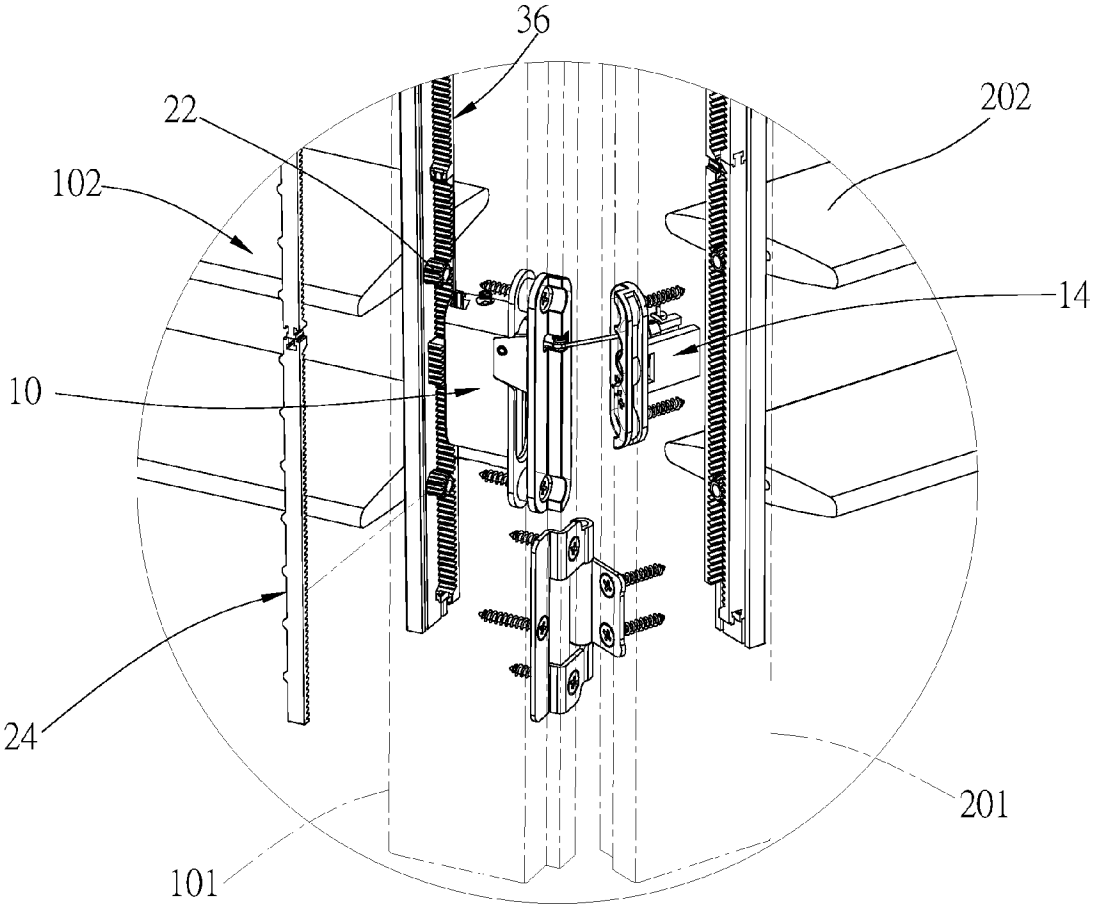
FIG. 3 is a perspective view, showing the relation between an automatic closing structure of a preferred embodiment of the present invention and the aforementioned sashes.
Figure 4:
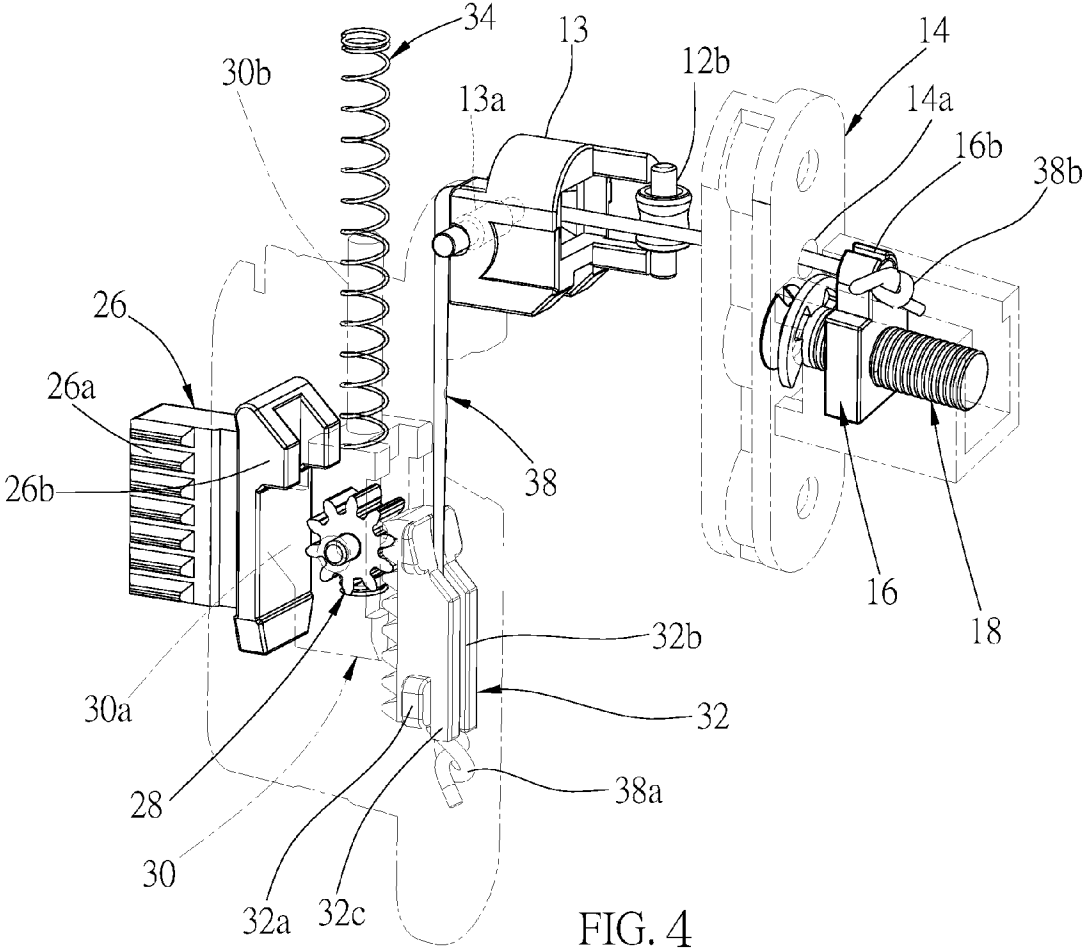
FIG. 4 is a perspective view, showing the automatic closing structure of the preferred embodiment of the present invention.
Figure 5:
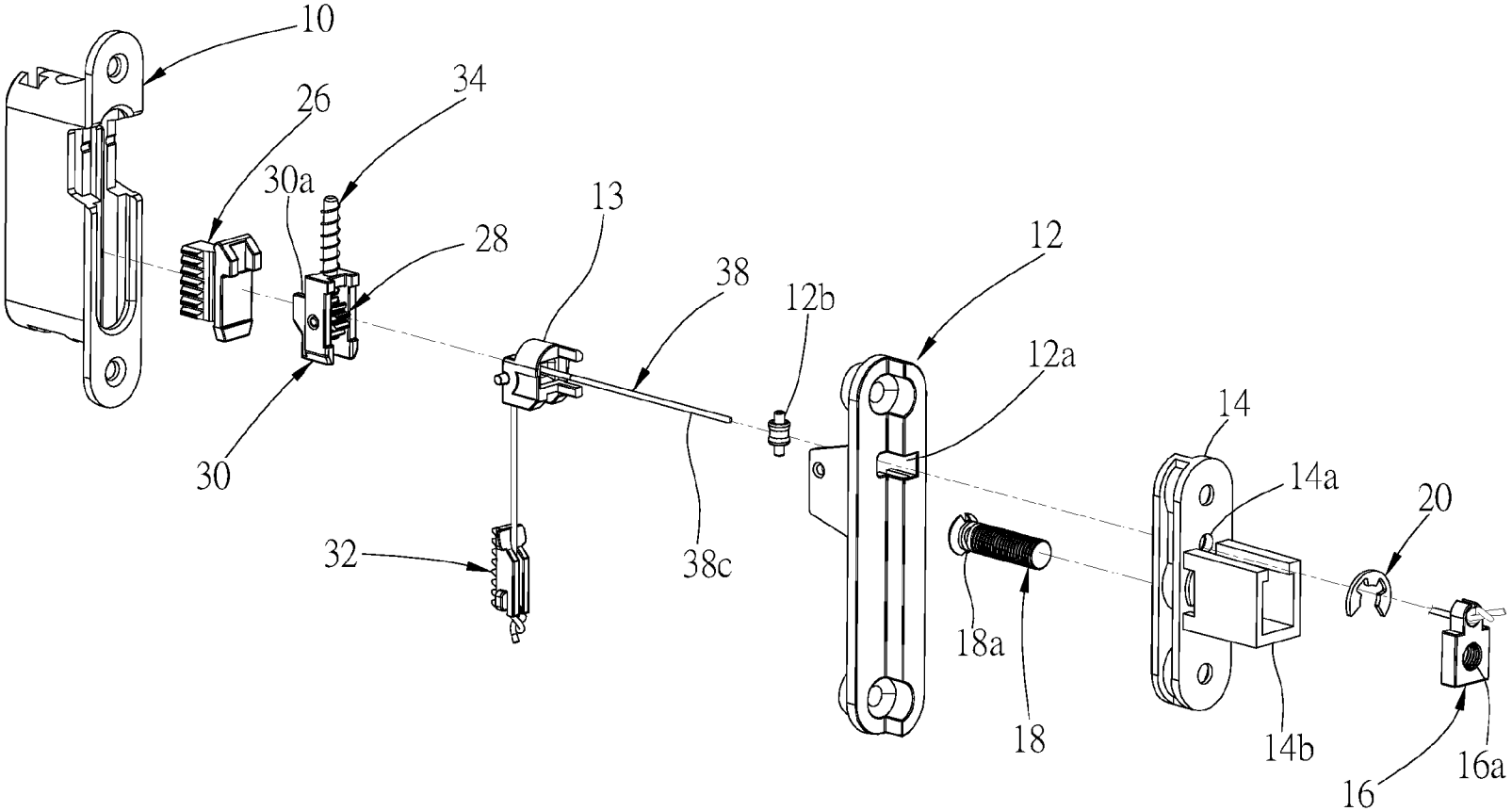
FIG. 5 is an exploded view, showing some components of the automatic closing structure of the preferred embodiment of the present invention.
Figure 6:
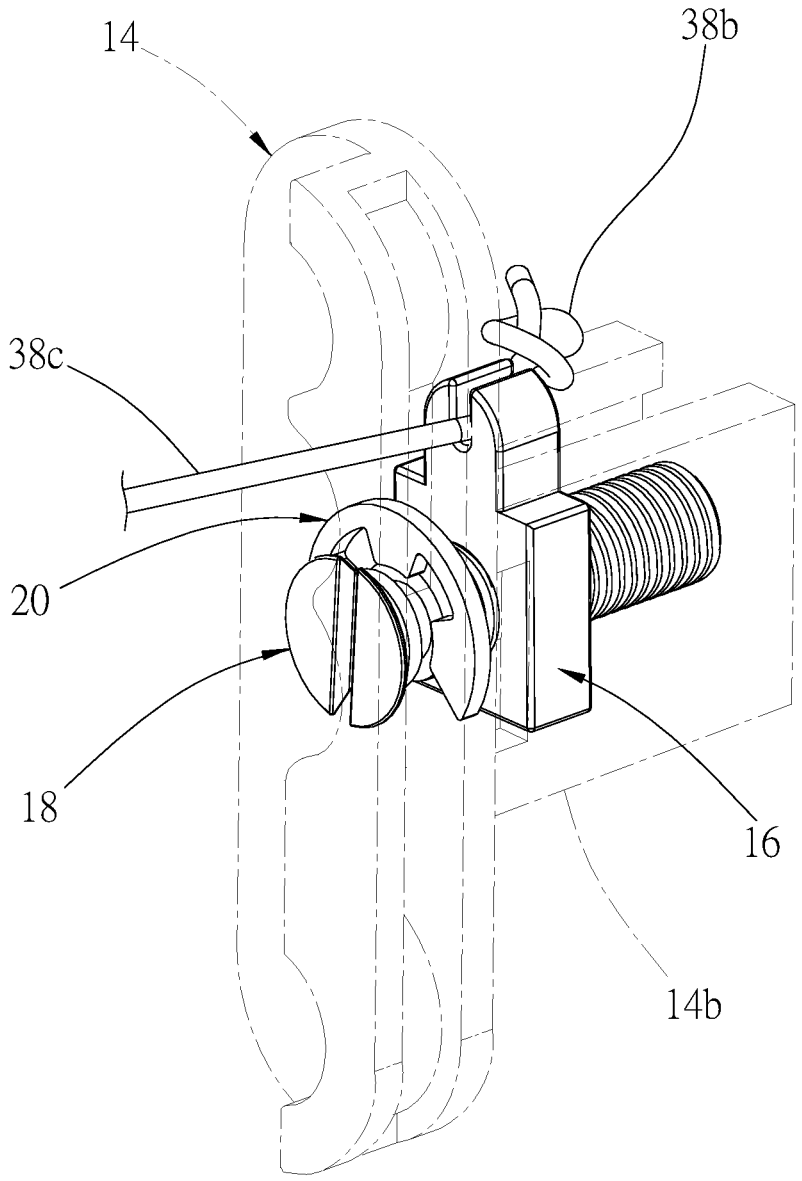
FIG. 6 is a perspective view, showing the locating seat and the adjusting member of the automatic closing structure of the preferred embodiment of the present invention.
Figure 7:
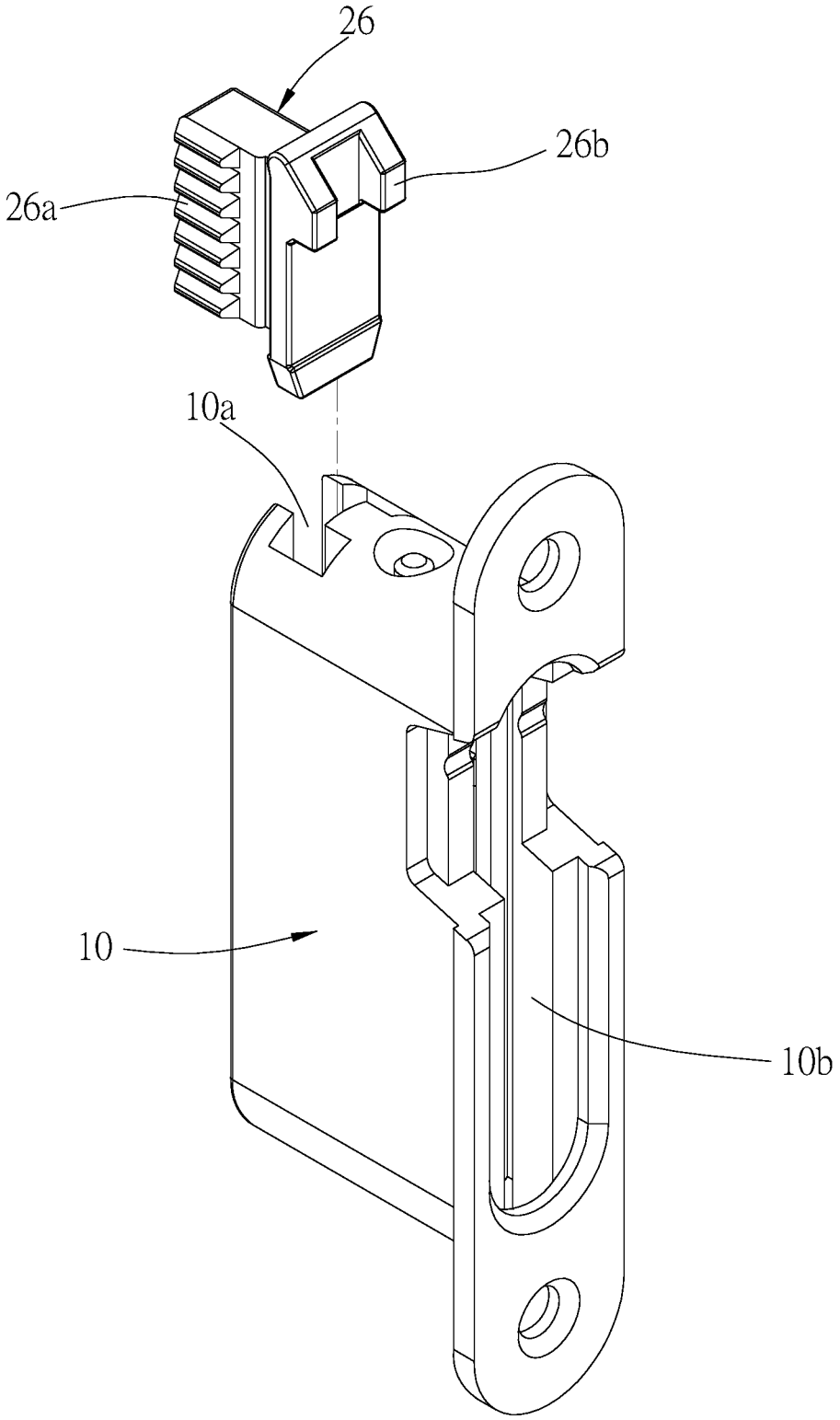
FIG. 7 is a perspective view, showing base and the follower block of the automatic closing structure of the preferred embodiment of the present invention.
Figure 8:
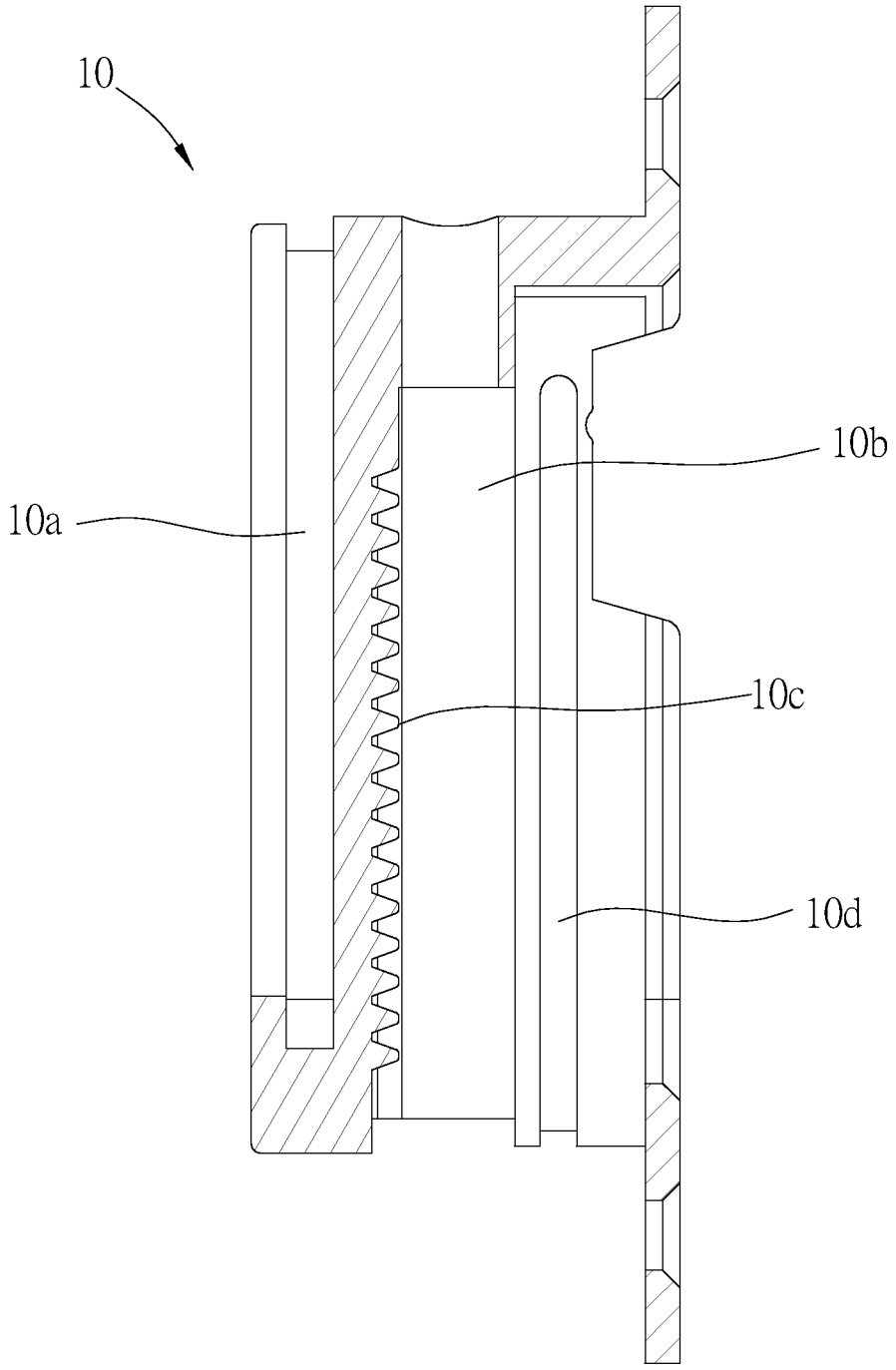
FIG. 8 is a sectional view, showing inner structure of the base of the automatic closing structure of the preferred embodiment of the present invention.

As shown in FIG. 3, the first linkage member 24 is a rack, and there is another fixed and unmovable rack 36 provided directly in front of teeth of the first linkage member 24, wherein the first linkage member 24 and the rack 36 are parallel to each other, and the rotary members 22 mesh with the teeth of the first linkage member 24 and the rack 36 at the same time. In other words, the rotary members 22 can be rotated simultaneously to consequently turn the slats 102 by simply moving the first linkage member 24 upward or downward.

The follower block 26 of the follower assembly has a short rack 26*a* on a left side surface thereof, wherein the short rack 26*a* extends out of the base 10, and is located between the first linkage member 24 and the rack 36. The short rack 26*a* meshes with the teeth of the first linkage member 24. The follower block 26 has a first protrusion 26*b* on a right side thereof, wherein the first protrusion 26*b* extends into the trough 10*b*. The gear 28 is provided in the movable block 30, and is rotatable therein, wherein the gear 28 meshes with the rack 10*c* inside the base 10. The movable block 30 has a second protrusion 30*a* abutting against a bottom surface of the first protrusion 26*b*. As for the second linkage member 32, it mainly meshes with the gear 28 through flat teeth 32*d* thereof, and is located at another side opposite to the rack 10*c* of the base 10. The second linkage member 32 has two guide block 32*a*, each of which is respectively projected from one of two lateral walls thereof, wherein each of the guide blocks 32*a* is located in one of the guideways 10*d* of the base 10. The second linkage member 32 further has a longitudinal slit 32*b*, and has an extended portion 32*c* at a bottom thereof. The biasing member 34 is a spring which fits around a post 30*b* on a top of the movable block 30, wherein the biasing member 34 abuts against an inner wall of a top of the base 10 with an end thereof, and abuts against the top of the movable block 30 with another end thereof. Whereby, the biasing force is exerted on the movable block 30, which not only keeps pushing the movable block 30 downwardly, but also helps to eliminate gaps formed between the rack 10*c*, the gear 28, and the second linkage member 32. As a result, the rack 10*c*, the gear 28, and the second linkage member 32 can maintain a good contact relation between each other.

With the aforementioned design, when the movable block 30 is moved upward, the follower block 26 will be pushed upward as well. At this time, the follower block 26 further brings the first linkage member 24 together to rotate the rotary members 22. The method of moving the movable block 30 upward is to move the second linkage member 32 upward along the guideway 10*d* of the base 10, and by doing so, the second linkage member 32 drives the gear 28 to rotate upward along the fixed rack 10*c*. In other words, to turn the slats 102, the second linkage member 32 has to eventually move the first linkage member 24 along a linear direction with the gear 28, the movable block 30, and the follower block 26 as intermediate components.

The linkage device is used to move the follower assembly, so that the rotary members 22 are moved relative to the first linkage member 24. In the preferred embodiment, the linkage device includes a cord 38, wherein two ends of the cord 38 are respectively a first stop portion 38*a* and a second stop portion 38*b*, which are both knots, wherein the cord 38 has a cord portion 38*c* between the first stop portion 38*a* and the second stop portion 38*b*. The cord portion 38*c* passes through the bore 12*a* of the lateral lid 12 and the bore 14*a* of the locating seat 14, and runs around the direction changing wheel 12*b* and the direction changing wheel 13*a*, wherein a part of the cord portion 38*c* is further located in the positioning aperture 16*b* of the mobile block 16 and the slit 32*b* of the second linkage member 32. The first stop portion 38*a* abuts against a bottom surface of the second linkage member 32, and also abuts against the extended portion 32*c* through the guiding of the slit 32*b*, which prevents the cord 38 from being disengaged from the second linkage member 32. Therefore, the first stop portion 38*a* is firmly connected to the follower assembly. As for the second stop portion 38*b*, it abuts against a rear surface of the mobile block 16 to prevent from disengaging. In other words, the second stop portion 38*b* is connected to the second sash 200 through the mobile block 16.

Figure 9:
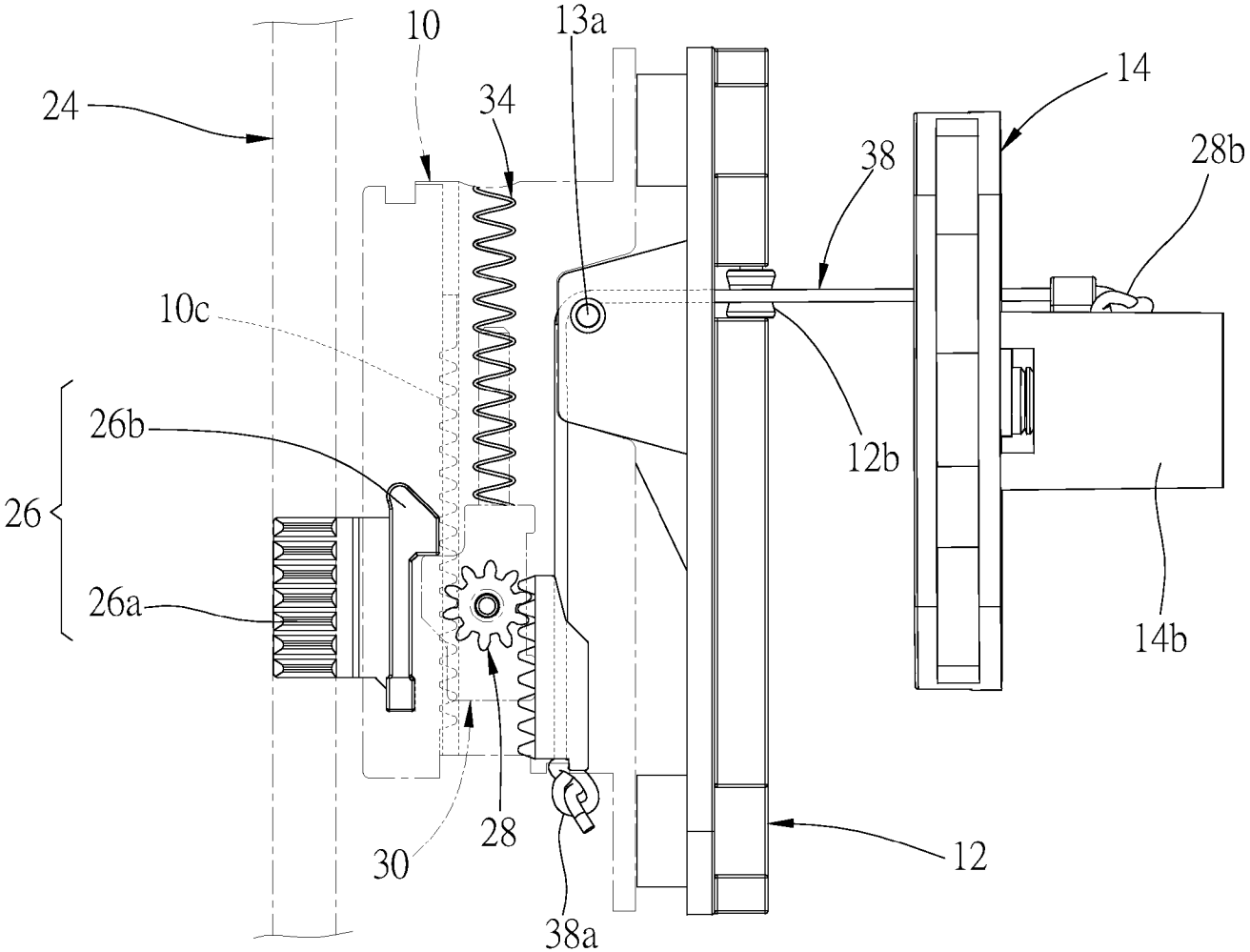
FIG. 9 is a schematic view, showing the follower assembly of the automatic closing structure of the preferred embodiment of the present invention is located at the bottom of the base.
Figure 10:
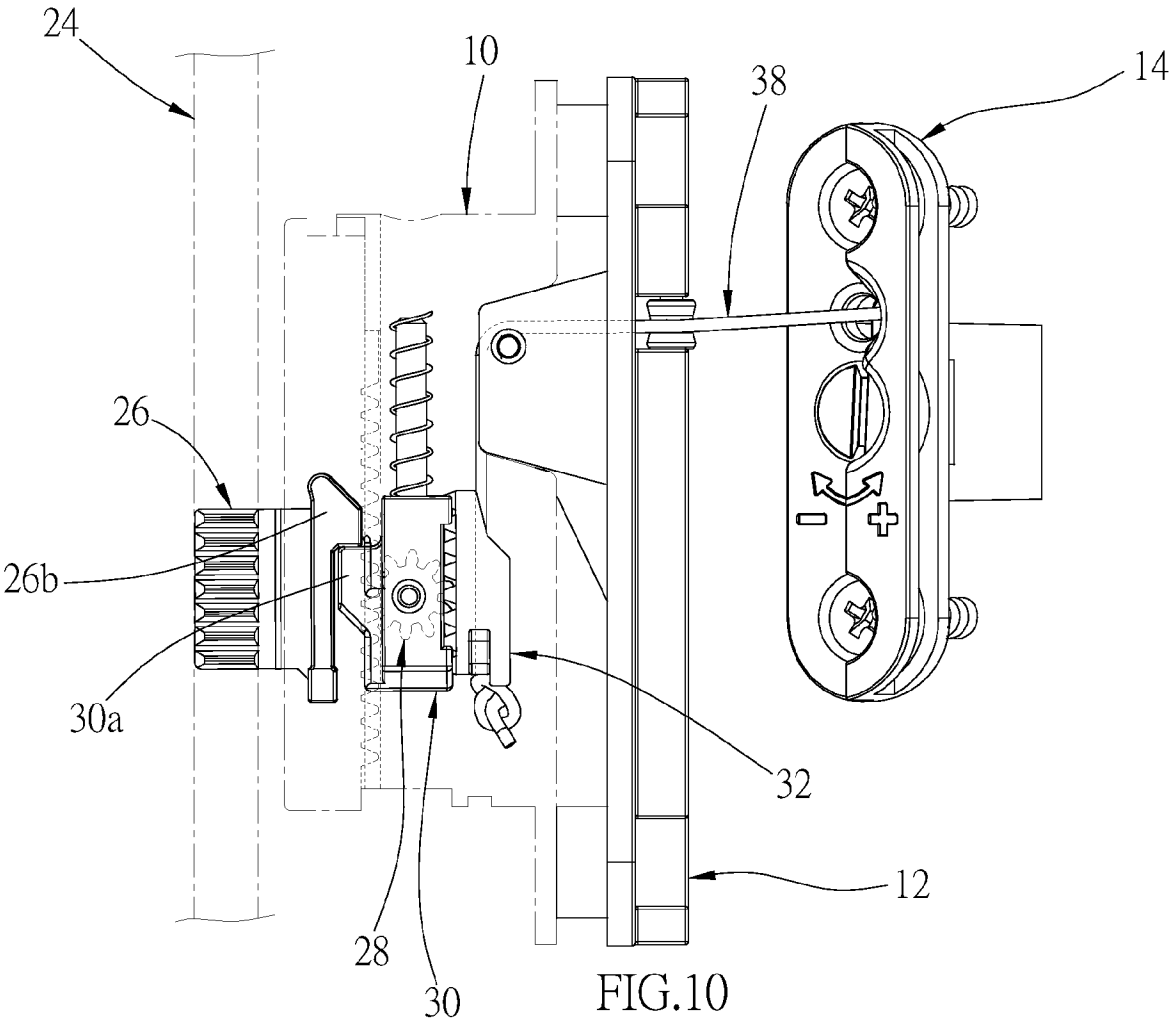
FIG. 10 is a schematic view, showing the follower assembly of the automatic closing structure of the preferred embodiment of the present invention is moved upward.
Figure 11:
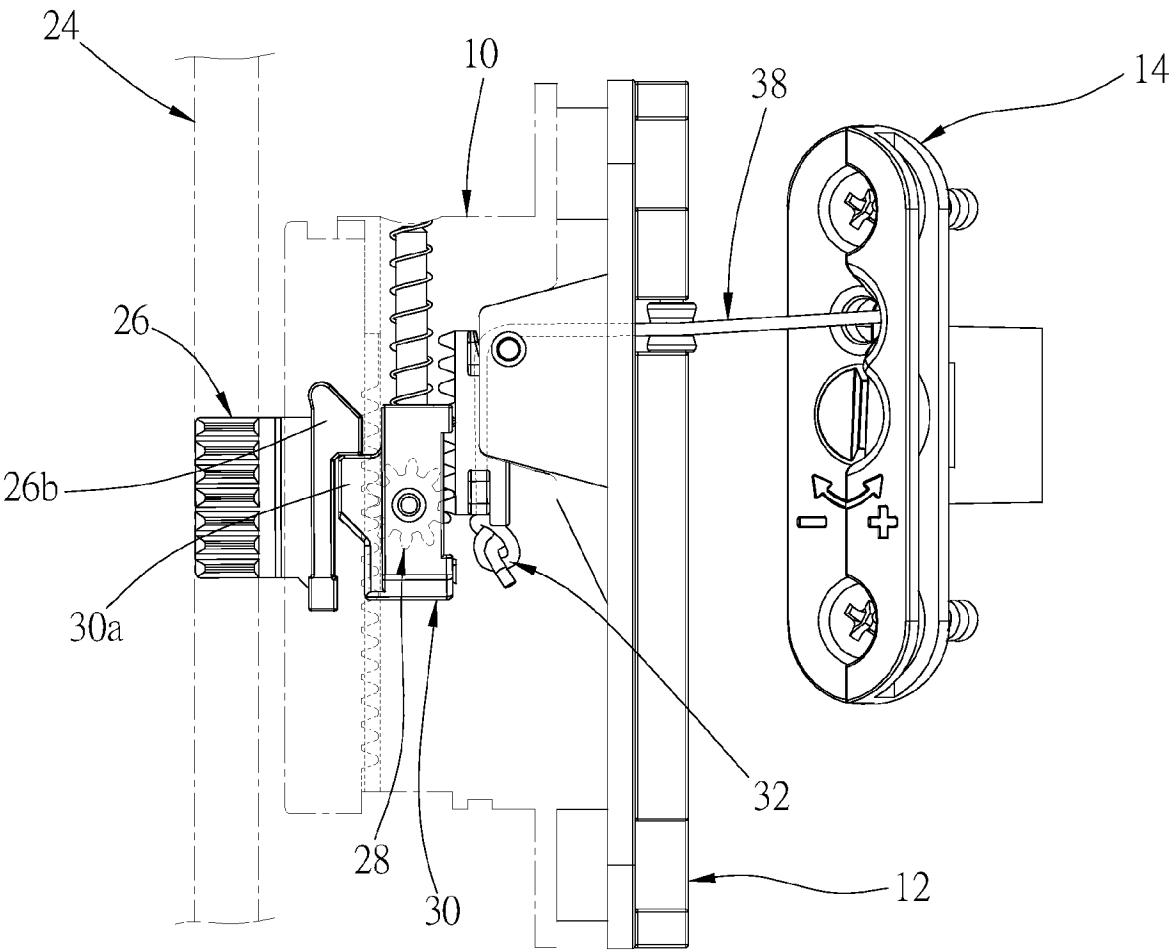
FIG. 11 is a schematic view, showing the follower assembly of the automatic closing structure of the preferred embodiment of the present invention is moved upward and approaching the top of the base.

Since a length of the cord portion 38*c* is fixed, when the first sash 100 and the second sash 200 are arranged side by side to close the opening of the building, and when the slats 102 (202) are arranged horizontally, the follower assembly is located at a bottom of the base 10 as shown in FIG. 9. During the process of opening the opening of the building, the second linkage member 32 is pulled by the cord 38 and therefore moved upward, as illustrated in FIG. 10. It can be understood from the above description that, the second linkage member 32 moves the first linkage member 24 to rotate the rotary members 22 with the gear 28, the movable block 30, and the follower block 26 as intermediate components; meanwhile, the slats 102 automatically and gradually close the opening of the building till the follower assembly is moved to be located near a top of the base 10, as illustrated in FIG. 11, wherein the slats 102 completely close the opening at this time.

Because there are two automatic closing structures included in the preferred embodiment, and these two automatic closing structures are installed in opposite ways, the slats of the first sash 100 and the second sash 200 are automatically turned from a horizontal direction to a vertical direction while these sashes 100, 200 are being opened. In this way, the slats of each sash 100, 200 won't collide with each other, and therefore the first sash 100 and the second sash 200 can be smoothly folded and arranged in parallel. Even if the sash is moved to against a wall, the vertically arranged slats won't collide with the wall, and therefore won't be damaged or cause harm to others.

In the above description, the opening of the building is covered by two sashes. However, in practice, there can be only one sash applied to cover the opening of the building. In the case of having only one sash, of course only one automatic closing structure is needed. In other words, the locating seat 14 and the adjusting member are installed in the window frame, and the components including the base 10, the lateral lid 12, and the follower assembly are provided inside the frame of the sash.

In the above description, the slit 32*b* of the second linkage member 32 has an open surface, and therefore while assembling the cord 38, the cord portion 38*c* can be easily disposed in the slit 32*b*. Similarly, in order to quickly assembly the cord portion 38*c*, the positioning aperture 16*b* of the mobile block 16 can be alternatively designed to have an open lateral surface. With such design, the knots at two ends of the cord 38 can be used as means of preventing disengagement, which also improves the efficiency of assembling the components. In addition, if the cord 38 is required to be replaced, a user only needs to disassemble the lateral lid 12 and the locating seat 14, then the cord 38 can be easily replaced, which is simple and convenient.

Figure 12:
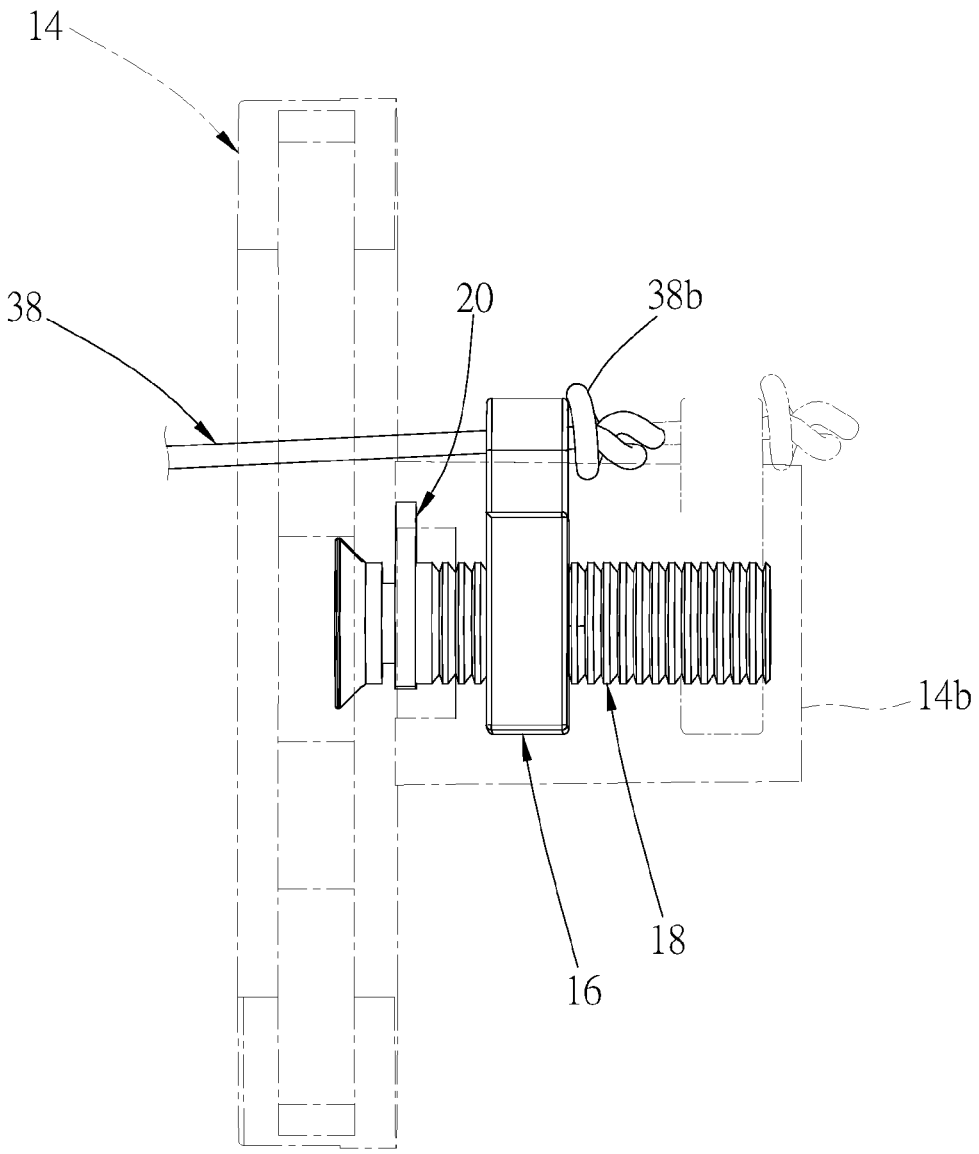
FIG. 12 is a schematic view, showing the mobile block and screw rod of the adjusting member of the automatic closing structure of the preferred embodiment of the present invention.

After the cord 38 is disposed in place, if it needs to be tightened or loosened, a user can rotate the screw rod 18 with a tool to move the mobile block 16 which is engaged with the cord 38 forward or backward, as shown in FIG. 12, to tighten or to loosen the cord 38. In the preferred embodiment, a top surface of the screw rod 18 has a single slot, which can be screwed with a flathead screwdriver.

It is worth mentioning that, because the rack 10*c* is fixed and unmovable, the gear 28 meshes with the rack 10*c*, and then the second linkage member 32 meshes with the gear 28 with the flat teeth 32*d* thereof, when the gear 28 is rotated and moved, the second linkage member 32 is moved outward relative to the gear 28. With this clever design, the operation is efficient, because the moving distance of the movable block 30 is shorter than the upward moving distance of the second linkage member 32 while it is pulled by the cord 38. In addition, by precisely designing the moving distances of the second linkage member 32 and the movable block 30, the rotary members 22 are prevented from being extensively rotated, which ensures the slats don't push each other too much.

As it can be seen from the above description, the cord 38 of the automatic closing structure provided in the present invention can be easily and conveniently assembled and even replaced. Furthermore, the tightness of the cord 38 can be adjusted to meet different requirements. In addition to these two advantages, the cleverly designed arrangement between the rack 10*c*, the gear 28, and the second linkage member 32 helps to prevent the slats from being excessively closed, and therefore ensures the slats are not damaged by such cause.

Figure 13:
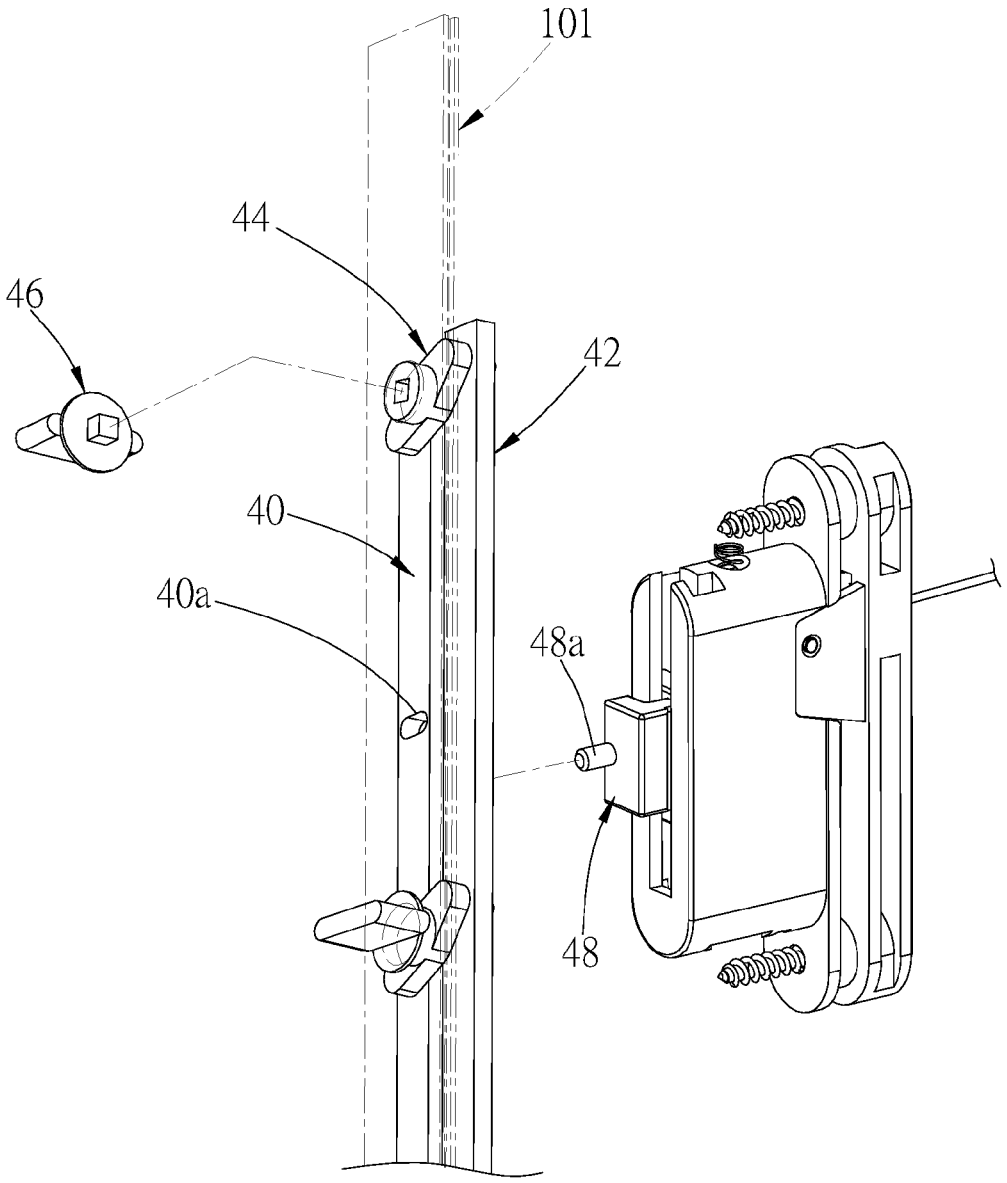
FIG. 13 is a perspective view, showing some components of an automatic closing structure of an alternative preferred embodiment of the present invention.
Figure 14:
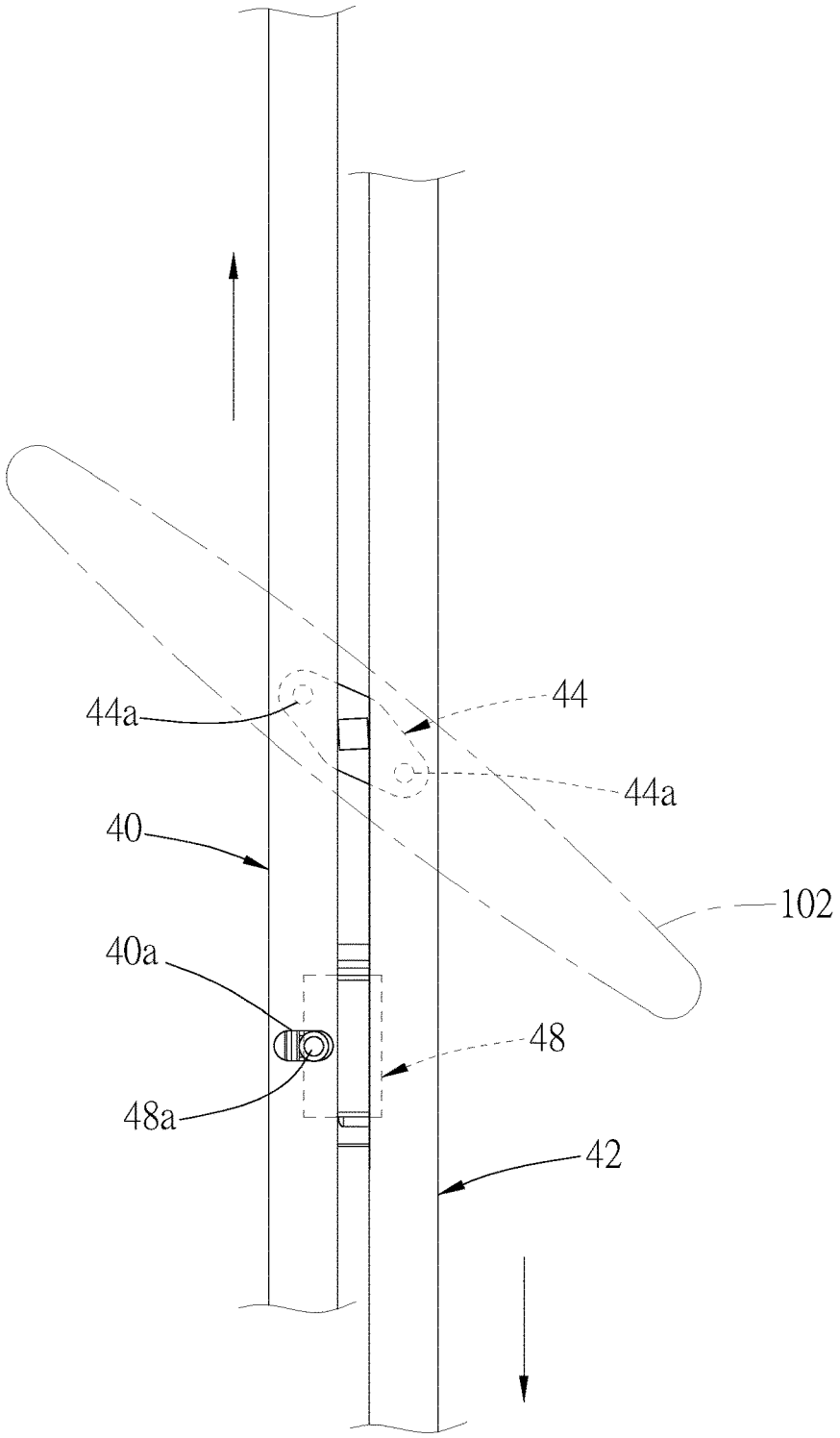
FIG. 14 is a schematic view, showing the follower assembly of the automatic closing structure of the aforementioned alternative preferred embodiment of the present invention is moved upward.

In the aforementioned preferred embodiment, the slats can be turned through the gear (i.e., the rotary member 22) provided at a side of each sash, wherein the gears can be rotated by moving the rack (i.e., the first linkage member 24). However, in practice, there is an alternative way to turn the slats, and this alternative preferred embodiment is illustrated in FIG. 13 and FIG. 14. The main difference is that, a first linkage member of the alternative preferred embodiment is a first long shaft 40 which has no teeth, and each of rotary members 44 is a block, which has a pivot 44*a* provided at and end thereof corresponding to the first long shaft 40, wherein the pivot 44*a* is inserted into the first long shaft 40. Each of the rotary members 44 is connected to a corresponding slat 102 through an external connector 46. This alternative preferred embodiment has a special design: the rotary member 44 and the external connector 46 are disengagably connected to each other through a rectangular countersink and a rectangular post, whereby the external connector 46 can be moved by the rotary member 44 to rotate relative to the frame 101. To better simultaneously rotate the rotary members, a second long shaft 42 can be further provided in practice as illustrated in FIG. 13 and FIG. 14, which is parallel to the first long shaft 40, and also has no teeth. Each of the rotary members 44 has two pivots 44*a* at two ends thereof, which respectively corresponds to the first long shaft 40 and the second long shaft 42, wherein the pivots 44*a* are respectively inserted into the second long shaft 42 and the first long shaft 40.

In addition, the follower block 48 has a rod 48*a* on a side thereof, wherein the rod 48*a* is inserted into a connecting hole 40*a* of the first long shaft 40. Whereby, when the follower block 48 is moved due to the indirect control of the cord, the first long shaft 40 is moved upward or downward, and therefore the rotary members 44 are rotated. As a result, the external connectors 46 are also rotated to turn the slats 102. It must be pointed out that the embodiments described above are only some preferred embodiments of the present invention. All equivalent structures which employ the concepts disclosed in this specification and the appended claims should fall within the scope of the present invention.

What is claimed is:

1. An automatic closing structure, which is installed between a sash and a corresponding object, wherein the sash is pivotable relative to the corresponding object, and the sash comprises a frame and a plurality of turnable slats which are arranged in parallel in the frame; comprising a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member; wherein:

the follower assembly comprises a second linkage member, which is controllable to move the first linkage member in a linear direction; and the linkage device comprises a cord, which has a first stop portion, a second stop portion, and a cord portion located between the first stop portion and the second stop portion, wherein the first stop portion is connected to the second linkage member, and the second stop portion is connected to the corresponding object.

2. The automatic closing structure of claim 1, wherein the second linkage member has a slit; a part of the cord portion which is near the first stop portion passes through the slit, so that the first stop portion is guided to abut against the second linkage member.

3. The automatic closing structure of claim 1, further comprising a rack, which is fixedly provided in the frame, wherein the follower assembly comprises a gear and a movable block; the gear is rotatably provided in the movable block, and meshes with the rack; the second linkage member has a flat teeth meshing with the gear at a side opposite to the rack; the second linkage member is adapted to be pulled by the cord, which moves the movable block to consequently move the first linkage member.

4. The automatic closing structure of claim 3, wherein the follower assembly comprises a follower block, which has a short rack meshing with teeth of the first linkage member; each of the rotary members comprises a gear meshing with the teeth of the first linkage member, so that the rotary member is adapted to be relatively moved by the first linkage member.

5. The automatic closing structure of claim 4, wherein the follower block has a first protrusion, and the movable block has a second protrusion; the second protrusion abuts against a bottom surface of the first protrusion, so that the movable block is adapted to push the follower block upward, which consequently moves the first linkage member upward.

6. The automatic closing structure of claim 5, further comprises a locating seat and an adjusting member, wherein the locating seat is fixed on the corresponding object, and the adjusting member has a mobile block movably provided on the locating seat; the locating seat has a perforation; and the mobile block of the adjusting member has a threaded hole; the adjusting member comprises a screw rod, which is screwed into the threaded hole of the mobile block through the perforation, wherein the screw rod is rotatable in situ, and the mobile block is movable on the locating seat along the screw rod.

7. The automatic closing structure of claim 3, wherein the first linkage member of the follower assembly is a first long shaft; each of the rotary members has a pivot, which is respectively inserted into the first linkage member.

8. The automatic closing structure of claim 7, wherein the follower assembly further comprises a follower block; the first linkage member has a connecting hole, and the follower block has a rod, which is inserted into the connecting hole, so that the first linkage member and the follower block are adapted to be moved together.

9. The automatic closing structure of claim 8, wherein the follower block has a first protrusion, and the movable block has a second protrusion; the second protrusion abuts against a bottom surface of the first protrusion, so that the movable block is adapted to push the follower block upward, which consequently moves the first linkage member upward.

10. The automatic closing structure of claim 9, further comprises a locating seat and an adjusting member, wherein the locating seat is fixed on the corresponding object, and the adjusting member has a mobile block movably provided on the locating seat; the locating seat has a perforation; and the mobile block of the adjusting member has a threaded hole; the adjusting member comprises a screw rod, which is screwed into the threaded hole of the mobile block through the perforation, wherein the screw rod is rotatable in situ, and the mobile block is movable on the locating seat along the screw rod.

11. An automatic closing structure, which is installed between a sash and a corresponding object, wherein the sash is pivotable relative to the corresponding object, and the sash comprises a frame and a plurality of turnable slats which are arranged in parallel in the frame; comprising a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member; wherein:

the automatic closing structure comprises a rack fixedly provided in the frame; and the follower assembly comprises a gear, a movable block, and a second linkage member, wherein the gear is rotatably provided in the movable block, and meshes with the rack; the second linkage member has a flat teeth meshing with the gear at a side opposite to the rack;

the second linkage member is controllable to move the movable block, and to consequently move the first linkage member in a linear direction.

12. The automatic closing structure of claim 11, wherein the follower assembly further comprises a follower block, which has a short rack meshing with teeth of the first linkage member; the rotary member comprises a gear meshing with the teeth of the first linkage member; the follower block has a first protrusion, and the movable block has a second protrusion; the second protrusion abuts against a bottom surface of the first protrusion, so that the movable block is adapted to push the follower block upward, which consequently moves the first linkage member upward.

13. The automatic closing structure of claim 12, wherein the linkage device comprises a cord, which has a first stop portion, a second stop portion, and a cord portion located between the first stop portion and the second stop portion, wherein the first stop portion is connected to the second linkage member, and the second stop portion is connected to the corresponding object.

14. The automatic closing structure of claim 13, further comprises a locating seat and an adjusting member, wherein the locating seat is fixed on the corresponding object, and the adjusting member has a mobile block movably provided on the locating seat; the locating seat has a perforation; and the mobile block of the adjusting member has a threaded hole; the adjusting member comprises a screw rod, which is screwed into the threaded hole of the mobile block through the perforation, wherein the screw rod is rotatable in situ, and the mobile block is movable on the locating seat along the screw rod.

15. The automatic closing structure of claim 13, wherein the second linkage member has a slit; a part of the cord portion which is near the first stop portion passes through the slit, so that the first stop portion is guided to abut against the second linkage member.

16. The automatic closing structure of claim 11, wherein the follower assembly further comprises a follower block; the first linkage member of the follower assembly is a first long shaft, each of the rotary members has a pivot, which is respectively inserted into the first linkage member; the follower block has a first protrusion, and the movable block has a second protrusion; the second protrusion abuts against a bottom surface of the first protrusion, so that the movable block is adapted to push the follower block upward, which consequently moves the first linkage member upward.

17. The automatic closing structure of claim 16, wherein the first linkage member has a connecting hole, and the follower block has a rod inserted into the connecting hole, so that the first linkage member and the follower block are adapted to be moved together.

18. The automatic closing structure of claim 16, wherein the linkage device comprises a cord, which has a first stop portion, a second stop portion, and a cord portion located between the first stop portion and the second stop portion, wherein the first stop portion is connected to the second linkage member, and the second stop portion is connected to the corresponding object.

19. The automatic closing structure of claim 18, further comprises a locating seat and an adjusting member, wherein the locating seat is fixed on the corresponding object, and the adjusting member has a mobile block movably provided on the locating seat; the locating seat has a perforation; and the mobile block of the adjusting member has a threaded hole; the adjusting member comprises a screw rod, which is screwed into the threaded hole of the mobile block through the perforation, wherein the screw rod is rotatable in situ, and the mobile block is movable on the locating seat along the screw rod.

20. The automatic closing structure of claim 18, wherein the second linkage member has a slit; a part of the cord portion which is near the first stop portion passes through the slit, so that the first stop portion is guided to abut against the second linkage member.

21. An automatic closing structure, which is installed between a sash and a corresponding object, wherein the sash is pivotable relative to the corresponding object, and the sash comprises a frame and a plurality of turnable slats which are arranged in parallel in the frame; comprising a follower assembly, a linkage device, and a plurality of rotary members, wherein each of the rotary members is respectively provided at an end of each of the slats; the follower assembly is movably provided in the frame, and comprises a first linkage member to be engaged with the rotary members; the linkage device is adapted to move the follower assembly, which moves the rotary members relative to the first linkage member; wherein:

the automatic closing structure comprises a locating seat and an adjusting member, wherein the locating seat is fixed on the corresponding object, and has a bore; the adjusting member has a mobile block movably provided on the locating seat; and the linkage device comprises a cord passing through the bore of the locating seat; the cord has a first stop portion, a second stop portion, and a cord portion located between the first stop portion and the second stop portion, wherein the first stop portion is connected to the follower assembly, and the second stop portion is connected to the mobile block.

22. The automatic closing structure of claim 21, wherein the locating seat has a perforation; the mobile block of the adjusting member has a threaded hole, and the adjusting member comprises a screw rod, which is screwed into the threaded hole through the perforation, and is rotatable in situ.

23. The automatic closing structure of claim 21, wherein the follower assembly comprises a second linkage member, which is controllable to move the first linkage member in a linear direction.

24. The automatic closing structure of claim 23, wherein the second linkage member has a slit; a part of the cord portion which is near the first stop portion passes through the slit, so that the first stop portion is guided to abut against the second linkage member.

25. The automatic closing structure of claim 23, further comprising a rack, which is fixedly provided in the frame, wherein the follower assembly comprises a gear and a movable block; the gear is rotatably provided in the movable block, and meshes with the rack; the second linkage member has a flat teeth meshing with the gear at a side opposite to the rack; the second linkage member is adapted to be pulled by the cord, which moves the movable block to consequently move the first linkage member.

26. The automatic closing structure of claim 25, wherein the follower assembly comprises a follower block, which has a short rack meshing with teeth of the first linkage member; each of the rotary members comprises a gear meshing with the teeth of the first linkage member; the follower block has a first protrusion, and the movable block has a second protrusion; the second protrusion abuts against a bottom surface of the first protrusion, so that the movable block is adapted to push the follower block upward, which consequently moves the first linkage member upward.

27. The automatic closing structure of claim 25, wherein the follower assembly comprises a follower block; the first linkage member of the follower assembly is a first long shaft; each of the rotary members has a pivot, which is respectively inserted into the first linkage member; the follower block has a first protrusion, and the movable block has a second protrusion; the second protrusion abuts against a bottom surface of the first protrusion, so that the movable block is adapted to push the follower block upward, which consequently moves the first linkage member upward.

28. The automatic closing structure of claim 27, wherein the first linkage member has a connecting hole, and the follower block has a rod, which is inserted into the connecting hole, so that the first linkage member and the follower block are adapted to be moved together.

* * * * *